US009617786B2

(12) United States Patent
Roberts

(10) Patent No.: US 9,617,786 B2
(45) Date of Patent: Apr. 11, 2017

(54) APPARATUS FOR RETAINING A BLIND, AND BLIND ASSEMBLY

(71) Applicant: Anthony Gerard Roberts, Currumbin (AU)

(72) Inventor: Anthony Gerard Roberts, Currumbin (AU)

(73) Assignee: FREEDOM SCREENS OF AUSTRALIA PTY LTD, Currumbin (AU)

( * ) Notice: Subject to any disclaimer, the term of this patent is extended or adjusted under 35 U.S.C. 154(b) by 0 days.

(21) Appl. No.: 14/728,361

(22) Filed: Jun. 2, 2015

(65) Prior Publication Data

US 2015/0345215 A1 Dec. 3, 2015

(30) Foreign Application Priority Data

Jun. 3, 2014 (AU) ..... 2014203018

(51) Int. Cl.

| | |
|---|---|
| ***A47H 3/00*** | (2006.01) |
| ***E06B 9/17*** | (2006.01) |
| ***E06B 9/42*** | (2006.01) |
| ***E06B 9/58*** | (2006.01) |

(52) U.S. Cl.

CPC ..... *E06B 9/42* (2013.01); *E06B 9/582* (2013.01); *E06B 2009/587* (2013.01)

(58) Field of Classification Search

CPC . E06B 9/58; E06B 9/581; E06B 9/582; E06B 2009/587; E06B 9/17046; E06B 3/308; Y10T 403/7047

USPC ..... 160/380, 371, 266, 267.1, 268.1, 269, 160/270, 271, 272, 273.1

See application file for complete search history.

(56) References Cited

U.S. PATENT DOCUMENTS

| | | | | |
|---|---|---|---|---|
| 2,574,330 | A * | 11/1951 | Judd | G05G 1/02 16/422 |
| 3,842,890 | A | 10/1974 | Kramer | |
| 3,911,990 | A | 10/1975 | Hoover et al. | |
| 4,359,081 | A | 11/1982 | Brower | |
| 4,658,879 | A | 4/1987 | Van Klompenburg | |
| 4,821,786 | A | 4/1989 | Johnston | |
| 4,825,921 | A | 5/1989 | Rigter | |

(Continued)

FOREIGN PATENT DOCUMENTS

| | | |
|---|---|---|
| AU | 50257/93 | 5/1994 |
| AU | 200154068 | 1/2002 |

(Continued)

*Primary Examiner* — Katherine Mitchell
*Assistant Examiner* — Jeremy Ramsey
(74) *Attorney, Agent, or Firm* — Richard M. Klein; Fay Sharpe LLP

(57) ABSTRACT

An apparatus for retaining a blind comprises: a first elongate element for attachment to a supporting structure; a second elongate element attachable to the first elongate element, in order to at least partially form a guide track providing a guide channel in which a part to be guided may be constrained, the first and second elements together at least partially defining the external surfaces of the guide track. The second elongate element is attachable to the first elongate element by displacement of the second element relative to the first element. The direction of displacement may be a direction substantially transverse to the direction of elongation of the first element.

16 Claims, 6 Drawing Sheets

(56) References Cited

U.S. PATENT DOCUMENTS

| | | | | |
|---|---|---|---|---|
| 4,884,617 | A | 12/1989 | Coenraets | |
| 5,090,468 | A | 2/1992 | Tedeschi | |
| 5,111,866 | A * | 5/1992 | Prostko | E06B 9/262 160/276 |
| 5,868,191 | A | 2/1999 | Blackmon, Jr. | |
| 6,082,432 | A | 7/2000 | Kissinger | |
| 6,119,758 | A | 9/2000 | Coenraets | |
| 6,405,781 | B2 | 6/2002 | Davies et al. | |
| 6,408,922 | B2 | 6/2002 | Desrochers | |
| 6,463,983 | B1 | 10/2002 | Lang | |
| 6,478,070 | B2 | 11/2002 | Poppema | |
| 6,629,555 | B2 | 10/2003 | DeBlock et al. | |
| 6,701,994 | B2 | 3/2004 | Goldenberg et al. | |
| 6,758,503 | B2 | 7/2004 | Sadler | |
| 6,854,505 | B2 | 2/2005 | Grubb et al. | |
| 6,899,380 | B2 | 5/2005 | Kralik et al. | |
| 6,959,748 | B2 | 11/2005 | Hudoba | |
| 7,017,644 | B1 | 3/2006 | Kraeutler | |
| 7,100,667 | B2 | 9/2006 | Tomita | |
| 7,210,513 | B2 | 5/2007 | Goldenberg et al. | |
| 7,275,581 | B2 | 10/2007 | Coenraets | |
| 7,370,685 | B2 | 5/2008 | Moriya et al. | |
| 7,487,816 | B2 | 2/2009 | Moriya et al. | |
| 7,669,634 | B2 | 3/2010 | Sugiyama et al. | |
| 7,841,377 | B2 | 11/2010 | Coenraets | |
| 7,861,761 | B2 | 1/2011 | Martineau et al. | |
| 7,967,052 | B2 | 6/2011 | Lin | |
| 8,011,413 | B2 | 9/2011 | Poppema | |
| 8,196,638 | B2 | 6/2012 | Roberts et al. | |
| 8,371,355 | B2 * | 2/2013 | Santoro | E06B 9/42 160/268.1 |
| 8,516,728 | B2 | 8/2013 | Jung | |
| 8,528,623 | B2 | 9/2013 | Roberts | |
| 8,656,978 | B2 | 2/2014 | Goldenberg et al. | |
| 8,662,138 | B2 | 3/2014 | Komatsu et al. | |
| 8,672,014 | B2 | 3/2014 | Coenraets | |
| 2001/0042346 | A1 | 11/2001 | Brioschi | |
| 2005/0098276 | A1 | 5/2005 | Agliolo Quartalaro | |
| 2005/0230065 | A1 | 10/2005 | Moriya et al. | |
| 2005/0274462 | A1 | 12/2005 | Nyffenegger et al. | |
| 2006/0289120 | A1 | 12/2006 | Pielmeier | |
| 2007/0029049 | A1 | 2/2007 | Martineau | |
| 2009/0229767 | A1 * | 9/2009 | Mullet | E06B 9/581 160/26 |
| 2009/0236050 | A1 | 9/2009 | Marzilli | |
| 2010/0101739 | A1 | 4/2010 | Coenraets | |
| 2010/0326605 | A1 | 12/2010 | Guillen Chico | |
| 2011/0114272 | A1 | 5/2011 | Roberts | |
| 2012/0061032 | A1 | 3/2012 | Snyder et al. | |
| 2012/0098301 | A1 | 4/2012 | Nakamura et al. | |
| 2012/0193045 | A1 | 8/2012 | Lin | |
| 2014/0041814 | A1 | 2/2014 | Roberts | |
| 2014/0076507 | A1 * | 3/2014 | Dibben | E06B 9/58 160/272 |
| 2014/0262084 | A1 | 9/2014 | Fleischman | |
| 2015/0361718 | A1 | 12/2015 | Hummel | |

FOREIGN PATENT DOCUMENTS

| | | | |
|---|---|---|---|
| AU | 201012240 | 5/2010 | |
| AU | 2010101509 | 11/2010 | |
| AU | 201312350 | 5/2013 | |
| AU | 201412734 | 6/2014 | |
| JP | 2002004753 | 1/2002 | |
| TW | 440652 | 6/2001 | |
| WO | WO 94/13923 | 6/1994 | |
| WO | WO 2011/111031 | 9/2011 | |
| WO | WO 2012/050518 A1 * | 4/2012 | E06B 9/40 |

* cited by examiner

STEP-1

STEP-2

STEP-3

STEP-4

3
2
120
132
130
140
142

144
142
140

APPARATUS FOR RETAINING A BLIND, AND BLIND ASSEMBLY

FIELD

The present disclosure relates to an apparatus for retaining a blind and to a blind assembly.

BACKGROUND

Blinds are used to allow temporary coverage of a window or other opening. A known form of blind is a roller blind, in which a flexible sheet of material is attached along a first edge thereof to a rotatable roller and along a second, opposed, edge thereof to a substantially rigid bar which can be moved relative to an area or opening to be covered, for example a window, to draw the blind across the opening.

In some cases the edges of the blinds which extend between the first and second edges are retained in guide tracks. This can avoid gaps between these edges and adjacent structure. Avoidance of such gaps can be desirable, for example to avoid undesirable passage of light or insects between the blind and the adjacent structure. Alternatively, or additionally, the retention of the blind edges in guide tracks may be desirable in order to restrain the blind against undesirable movement, for example in windy conditions.

However, the provision of such tracks may have certain drawbacks. For example, the tracks may be unsightly, may make removal of the blind and/or access to a retained edge of the blind difficult and/or time consuming, and/or may cause unwanted deformation of the blind, for example if the spacing between opposed tracks is incorrect for the width of the blind.

It would therefore be desirable if at least some embodiments in accordance with the present disclosure could mitigate one or more of these drawbacks, or at least provide a useful alternative to known tracks for blinds.

DEFINITION

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

SUMMARY

According to a first aspect of the present disclosure there is provided an apparatus for retaining a blind comprising:

a first elongate element for attachment to a supporting structure;

a second elongate element attachable to the first elongate element, in order to at least partially form a guide track providing a guide channel in which a part to be guided may be constrained, the first and second elements together at least partially defining the external surfaces of the guide track;

wherein the second elongate element is attachable to the first elongate element by displacement of the second element relative to the first element.

In an embodiment the second elongate element is attachable to the first elongate element by displacement of the second element relative to the first element in a direction substantially transverse to the direction of elongation of the first element.

In an embodiment the part to be guided is an edge of a blind.

In an embodiment the guide track provides an elongate slot connected to the channel to allow a part connected to the part to be guided to extend out of the channel via the slot.

In an embodiment the first elongate element provides a side wall of the elongate slot and the second elongate element provides a further side wall of the elongate slot.

In an embodiment the second element is attachable to the first element so that the directions of elongation of the first and second elements are substantially parallel.

In an embodiment the second elongate element is attachable to the first elongate element so that an external surface part of the second elongate element is substantially coplanar with an external surface part of the first elongate element.

In an embodiment the second elongate element is attachable to the first elongate element without the use of fasteners which extend through an external wall of the first elongate element or an external wall of the second elongate element.

In an embodiment the second elongate element is attachable to the first elongate element without the use of fasteners which extend through an external wall of the guide track.

In an embodiment the second elongate element is attachable to the first elongate element without the use of fasteners which contact an external surface of an external wall of the first elongate element or an external surface of an external wall of the second elongate element.

In an embodiment the second elongate element is attachable to the first elongate element without the use of fasteners which contact an external surface of an external wall of the guide track.

In an embodiment the first and second elements are mutually detachable in order to facilitate access to the interior of the guide channel and removal of the part to be guided from the channel.

In an embodiment the first and second elongate elements are attachable by an attachment arrangement comprising a receiving portion provided by one of the first and second elements, for retainable receipt of a retainable portion, retainable to the receiving portion, for providing attachment of the second elongate element to the first elongate element.

In an embodiment the receiving portion comprises one or more securing features.

In an embodiment the retainable portion comprises one or more securing features.

In an embodiment the one or more securing features of the retainable portion are adapted to cooperate with one or more complementary securing features of the receiving portion to enhance retention of the retainable portion by the receiving portion.

In an embodiment at least one of the securing features comprises a projection.

In an embodiment at least one of the securing features comprises a recess.

In an embodiment the retainable portion comprises a deformable portion receivable by the receiving portion, and the attachment arrangement further comprises a locking portion, adapted to lock the deformable portion to the receiving portion.

In an embodiment the locking portion is provided by the one of the first and second elongate elements which does not provide the receiving portion.

In an embodiment the locking portion is adapted to prevent disconnection of the one or more securing features of the deformable portion from the one or more complementary securing features of the receiving portion.

In an embodiment the receiving portion defines at least one receiving space for receiving at least part of the retainable portion therein.

In an embodiment the receiving portion comprises at least one receiving cavity for receiving at least part of the retainable portion therein.

In an embodiment the receiving portion comprises at least one elongate receiving channel.

In an embodiment the receiving portion is defined by the first elongate element.

In an embodiment the retainable portion is for retention relative to the receiving portion, for attachment of the second elongate element to the first elongate element.

In an embodiment the retainable portion comprises an insertion portion adapted to be retained in the receiving portion.

In an embodiment the insertion portion is provided by the second elongate element.

In an embodiment the apparatus for retaining a blind comprises a retainer element for assisting attachment of the second elongate element to the first elongate element.

In an embodiment the retainer element is elongate.

In an embodiment the retainer element comprises a retainable portion for retention relative to a receiving portion of the attachment arrangement.

In an embodiment the retainer element comprises a receiving portion for retainable receipt of a retainable portion of the attachment arrangement.

In an embodiment the retainer element is adapted to fit between the first and second elongate elements to assist connection thereof.

In an embodiment the retainer element comprises a retainable portion for retention relative to a receiving portion of one of the first and second elements.

In an embodiment the retainer element comprises the deformable portion.

In an embodiment the retainer element comprises a receiving portion for retainable receipt of a retainable portion of one of the first and second elements.

In an embodiment insertion of a retainable locking portion of one of the first and second elements to contact the receiving portion of the retainer element acts to lock the retainer element to a receiving portion of the other of the first and second elements.

In an embodiment insertion of the retainable locking portion is adapted to retain a securing feature of the retainer element in engagement with a complementary securing feature of one of the first and second elongate elements.

In an embodiment the retainable portion of the retainer element comprises at least two relatively moveable securing portions.

In an embodiment at least two relatively moveable securing portions are connected by a flexible portion of the retainer element.

In an embodiment the at least two relatively moveable securing portions are adapted to be retained in a spaced apart arrangement to secure the retainer element to one of the first and second elongate elements.

In an embodiment the at least two relatively moveable securing portions are adapted to be retained in a spaced apart arrangement to secure the retainer element to the first elongate element.

In an embodiment the at least two relatively moveable securing portions are adapted to be retained in a spaced apart arrangement by insertion of a retainable portion of the guide track therebetween.

In an embodiment retaining the two relatively moveable securing portions in a spaced apart arrangement is adapted to retain a securing feature of the retainer element in engagement with a complementary securing feature of one of the first and second elongate elements.

In an embodiment retaining the two relatively moveable securing portions in a spaced apart arrangement is adapted to retain a securing feature of the retainer element in engagement with a complementary securing feature of a receiving portion of one of the first and second elongate elements.

In an embodiment retaining the two relatively moveable securing portions in a spaced apart arrangement is adapted to retain a securing feature of the retainer element in engagement with a complementary securing feature of the receiving portion of the elongate element relative to which the retainable portion of the retainer element is retained.

In an embodiment when the two relatively moveable securing portions are not retained in a spaced apart arrangement the securing feature of the retainer element is disengageable from the complementary securing feature.

In an embodiment the securing feature of the retainer element comprises at least one of a projection and a recess, and the complementary securing feature of one of the first and second elongate elements is adapted to interact with the securing feature of the retainer element to secure the retainer element to said elongate element when the securing portions of the retainer element are in the spaced apart arrangement.

In an embodiment the at least two relatively moveable securing portions are adapted to be forced together to disengage the securing feature of the retainer element from the complementary securing feature.

In an embodiment insertion of a retainable portion of one of the first and second elements into the receiving portion of the retainer element causes the moveable securing portions to be retained in a spaced apart arrangement.

In an embodiment insertion of a retainable portion of one of the first and second elements into the receiving portion of the retainer element causes the moveable securing portions to be retained in a spaced apart arrangement to secure the retainer element to the receiving portion of the other of the first and second elements.

In an embodiment removal of the retainable portion of said one of the first and second elements from the receiving portion of the retainer element allows the moveable securing portions to be moved towards each other relative to the spaced apart arrangement.

In an embodiment the retainable portion of said one of the first and second elements can be removed from the receiving portion of the retainer element detachable by displacement in a direction substantially transverse to the direction of elongation of the first element.

In an embodiment the retainable portion of said one of the first and second elements can be removed from the receiving portion of the retainer element detachable by displacement in a direction substantially transverse to the direction of elongation of the second element.

In an embodiment the retainable portion of said one of the first and second elements can be removed from the receiving portion of the retainer element detachable by displacement in a direction substantially transverse to the direction of elongation of the retainer element.

In an embodiment the retainer element comprises a portion with a generally U-shaped cross section.

In an embodiment the the receiving portion of the retainer element comprises a portion with a generally U-shaped cross section.

In an embodiment the first and second elements are mutually detachable by displacement of the second element relative to the first element in a direction transverse to the direction of elongation of the first element.

In an embodiment the retainer element comprises a portion which provides an interior wall portion of the guide channel.

In an embodiment the retainer element comprises a portion which abuts and supports an external wall portion of the guide track.

In an embodiment the retainer element comprises a retainable portion for retention relative to a receiving portion of one of the first and second elements, and further comprises a portion which abuts and supports an external wall portion of the other of the first and second elements.

In an embodiment the retainer element comprises a portion which abuts and supports a wall portion of the guide track which at least partially defines a slot in the guide track for allowing connection between the part to be guided and a connected part external to the guide track.

In an embodiment the apparatus for retaining a blind comprises a constraining element adapted to be retained in the channel of the guide track.

In an embodiment the constraining element comprises: a structure defining an internal channel for constraining a part to be guided and a slot connected to the internal channel to allow connection between the part to be guided and a connected part external to the internal channel.

In an embodiment the constraining element further comprises: a plurality of resilient biasing members for contacting one or more internal walls of the channel of the guide track, and biasing the constraining element in the channel of the guide track.

In an embodiment the resilient biasing members are adapted to bias the constraining element away from said one or more internal walls.

In an embodiment the structure defining the internal channel of the constraining element is made of a different material to the resilient biasing members.

In an embodiment the constraining element is formed as a single unitary element.

In an embodiment the constraining element is formed by co-molding or co-extrusion.

In an embodiment the apparatus for retaining a blind comprises a bar arrangement adapted to be attached to a blind and to extend between two guide tracks.

In an embodiment the bar arrangement is adapted to engage the guide tracks.

In an embodiment the bar arrangement is adapted to frictionally engage the guide tracks.

In an embodiment the bar arrangement is adapted move, with a part of a blind to which it is attached, relative to the guide tracks.

In an embodiment the bar arrangement is adapted be attached to a bottom edge of a blind.

In an embodiment the bar arrangement comprises at least one engaging member.

In an embodiment the bar arrangement comprises at least one engaging member for frictionally engaging a guide.

The guide may comprise, or be provided as part of, the guide track.

In an embodiment at least one engaging member is biased, the bias being adapted to force the engaging member against a guide.

In an embodiment the bias is provided by a resilient member.

In an embodiment the force applied by an engaging member against a guide is sufficient to retain the blind in a desired position against a retraction force applied to a blind by a biased roller.

In an embodiment the bar arrangement comprises at least two engaging members for engaging a single guide.

In an embodiment the bar arrangement comprises at least one said engaging member at each end of a bar of the bar arrangement.

In an embodiment the bar arrangement comprises at least four engaging members, with two engaging members adapted for engaging a first guide and another two engaging members adapted for engaging a second guide.

In an embodiment the bar arrangement comprises at least two said engaging members at each end of a bar of the bar arrangement.

In an embodiment the bar arrangement comprises at least one bar end plate.

In an embodiment the bar arrangement comprises at least two bar end plates.

In an embodiment at least one engaging member is mounted on a bar end plate.

In an embodiment the bar end plate comprises a recess for at least partially accommodating the engaging member.

In an embodiment at least one engaging member is provided with a member support.

In an embodiment the member support is in the form of a stem.

In an embodiment a first end of the member support is attached to the engaging member and a second end of the member support is constrained to the a part of the bar assembly.

In an embodiment the member support extends through an aperture of the bar assembly.

In an embodiment the member support extends through an aperture in an end wall of a recess of the bar assembly.

In an embodiment a resilient member, for providing a bias to the engaging member, is provided between a wall of the bar assembly and the engaging member.

In an embodiment the resilient member extends around at least part of the member support.

In an embodiment the resilient member extends around at least part of the stem.

In an embodiment the resilient member is generally cylindrical in form.

In an embodiment the resilient member comprises a helical spring.

In an embodiment the bar arrangement is provided with an arrangement for reducing the force applied by an engaging member against a guide.

In an embodiment the arrangement for reducing the force applied by an engaging member against a guide is manually operable.

In an embodiment the arrangement for reducing the force applied by an engaging member against a guide comprises a manually engageable part coupled to said engaging member, and operable to reduce the force applied by the engaging member against the guide.

In an embodiment the manually engageable part is operable to apply a force to an engaging member substantially opposed to the bias of the engaging member.

In an embodiment the manually engageable part comprises a handle.

In an embodiment the manually engageable part is coupled to at least one engaging member located at each end of a bar of the bar arrangement, and is operable to reduce the force applied by the engaging members against associated guides.

In an embodiment the manually engageable part is operable to reduce the force applied by at least two engaging members substantially by a single operation by a user.

In an embodiment the manually engageable part is operable to reduce the force applied by at least two engaging members substantially simultaneously.

According to a second aspect of the present disclosure there is provided an apparatus for retaining a blind comprising a guide track assembled from an apparatus for retaining a blind in accordance with the first aspect.

The apparatus for retaining a blind from which the guide track of the second aspect is assembled may provide any one or more of the features, integers and/or attributes of the embodiments of the first aspect set out above.

According to a third aspect of the present invention there is provided a blind assembly comprising:

first and second guide track assemblies each in accordance with at least one of the first and second aspects;

a blind having first and second edge regions for retention in the channels of the first and second guide track assemblies; and a bar for location at an end of the blind.

In an embodiment the bar provides first and second outwardly biased members for contact with the respective first and second guide track assemblies.

In an embodiment the outwardly biased members are retractable by a manual operation of a user.

In an embodiment the blind assembly provides recesses on or adjacent the guide track assemblies, for retaining the outwardly biased members, and thereby retaining the blind in a selected position.

In an embodiment the blind assembly provides a roller, onto which the blind can be retracted.

The apparatus for retaining a blind of the fifth aspect may provide any one or more of the features, integers and/or attributes of the first aspect, and/or of the embodiments of the first aspect, set out above.

The bar may correspond to a bar assembly as set out in relation to the first aspect, and may comprise and/or provide any one or more of the features, integers and/or attributes of the bar assembly, and/or embodiments thereof, as set out above in relation to the first aspect.

According to a fourth aspect of the present disclosure there is provided an apparatus for retaining a blind comprising a constraining element for use in a channel of a support for a blind, the constraining element comprising: a structure defining an internal channel for constraining a part of a blind to be guided and a slot connected to the internal channel to allow connection between the part to be guided and the rest of the blind external to the internal channel; and a plurality of resilient biasing members for contacting an internal wall of the channel of the support for a blind, and biasing the constraining element in the channel of the support.

The constraining element may correspond may comprise and/or provide any one or more of the features, integers and/or attributes of the constraining element, and/or embodiments thereof, as set out above in relation to the first aspect.

According to a fifth aspect of the present disclosure there is provided an apparatus for retaining a blind comprising:

a first elongate element for attachment to a supporting structure;

a second elongate element attachable to the first elongate element, in order to at least partially form a guide track providing a guide channel in which a part to be guided may be constrained, the first and second elements together at least partially defining the external surfaces of the guide track;

and a third elongate element, adapted to be located between the first and second elongate elements in order to assist attachment of the second elongate element to first elongate element.

The apparatus for retaining a blind of the fifth aspect may provide any one or more of the features, integers and/or attributes of the first aspect, and/or of the embodiments of the first aspect, set out above.

The third elongate element may correspond to a retainer element, and may comprise and/or provide any one or more of the features, integers and/or attributes of the retainer element, and/or embodiments thereof, as set out above in relation to the first aspect.

According to a sixth aspect of the present disclosure there is provided an apparatus for retaining a blind comprising:

a bar arrangement adapted to be attached to a bottom of a blind and adapted to extend between structures providing an opening in which the blind is operable;

wherein the bar arrangement comprises a bar, and at least one engaging member provided at each end of the bar, the engaging members being adapted to engage the structures providing the opening in order to assist in retaining the blind in a desired position.

In an embodiment the bar arrangement is adapted to extend between two guide tracks.

In an embodiment the engaging members are adapted to frictionally engage the structures providing the opening.

In an embodiment the bar arrangement is adapted move, with a part of a blind to which it is attached, relative to the guide tracks.

According to a seventh aspect of the present disclosure there is provided a blind assembly comprising a blind and an apparatus for retaining a blind in accordance with any one or more of the first, second, fourth, fifth or sixth aspects.

Any of the above aspects may incorporate any desired and/or appropriate features described in relation to any of the above aspects.

BRIEF DESCRIPTION OF THE DRAWINGS

Embodiments will be described, by way of example only, with reference to the accompanying drawings in which:

FIG. 1(*b*) shows in transverse cross section a number of extrusions which can be used to provide the apparatus of FIG. 1(*a*);

FIG. 3(*b*) is an enlarged view of a bar end assembly shown in FIG. 3(*a*);

FIG. 4(*b*) is a cross sectional view on C-C of the blind assembly of FIG. 4(*a*);

DETAILED DESCRIPTION OF EMBODIMENTS

With reference to the drawings, embodiments of apparatus for retaining a blind will be described. Although the embodiments are described in relation to a blind suitable for internal use, such as at the interior side of a window, it will be appreciated that the present disclosure and embodiments described herein have applicability to other types of blinds, such as external blinds, including awning blinds.

Figure 1A:
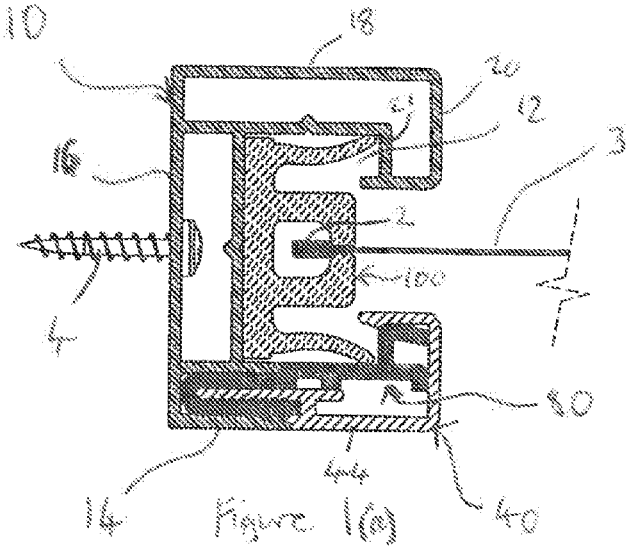
FIG. 1(*a*) shows in transverse cross section an embodiment of an apparatus for retaining a blind in accordance with the present disclosure.
Figure 1B:
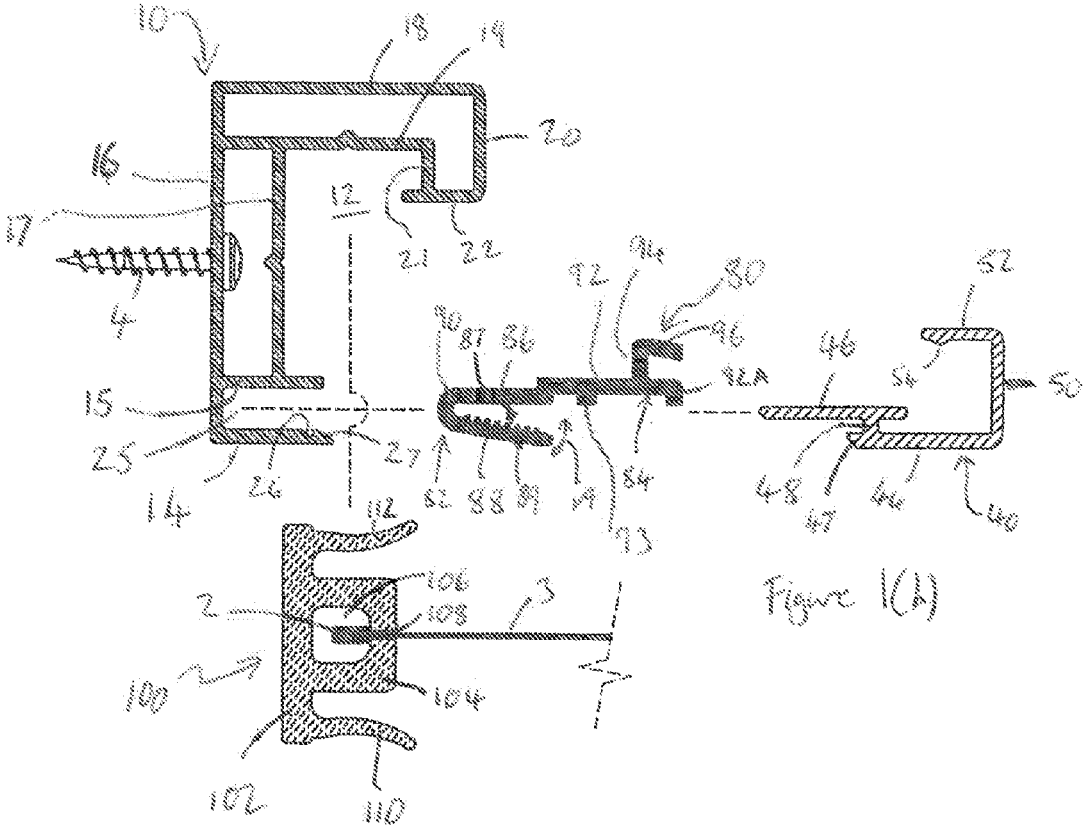
Figure 2A:
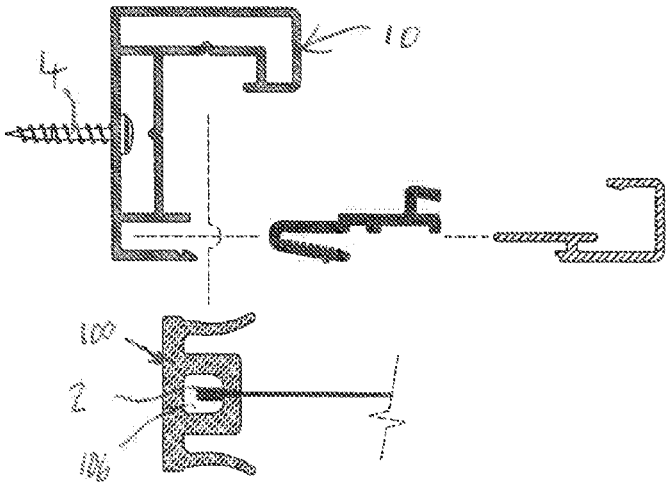
FIGS. 2(*a*) to 2(*d*) illustrate in cross sectional view, sequential steps in assembly of the apparatus of FIG. 1(*a*), using the extrusions shown in FIG. 1(*b*)
Figure 2B:
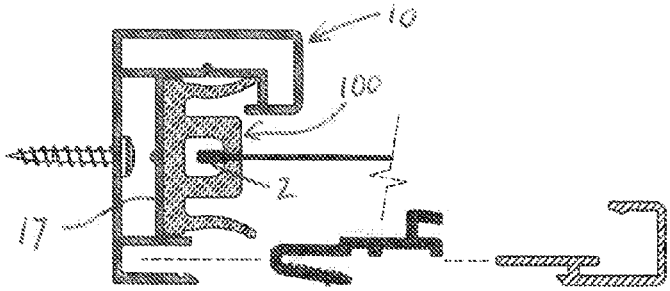
Figure 2C:
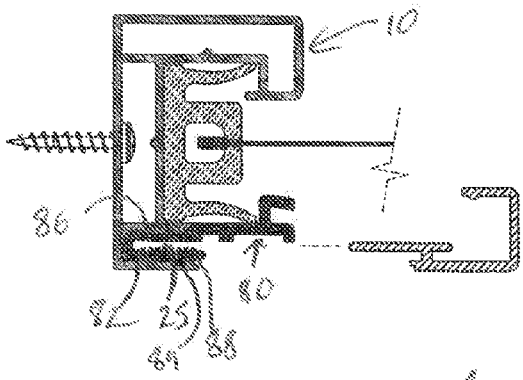
Figure 2D:
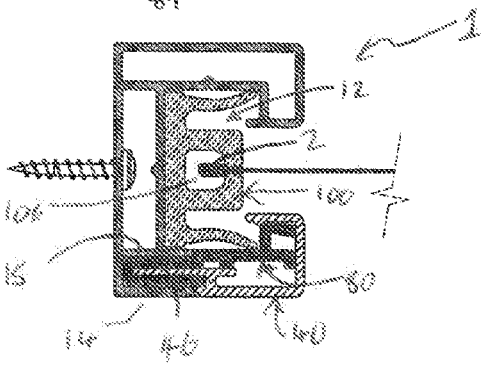

With particular reference to FIGS. 1(*a*) to 2(*d*), an embodiment of an apparatus for retaining a blind in the form of a track for a blind, generally designated by the reference numeral 1, will be described.

The track 1 comprises a number of components which can be assembled to entrap an edge portion 2 of a sheet material 3. The edge portion 2 may be, for example, a bead or other retainable structure, provided along an edge of a blind provided by the sheet material 3.

Briefly, these components comprise: a first elongate element in the form of an attachment component 10 for attaching to a support structure; a second elongate element in the form of an additional component 40 for connection to the attachment component 10, and a connection element in the form of connecting component 80 for connecting the additional component 40 to the attachment component 10. The attachment component 10, the at least one additional component 40, and the connecting component 80 together form a structure which at least partially defines a channel 12 within which edge portion 2 can be retained in use.

In the illustrated embodiment the edge portion 2 is retained in an inner retainer member 100, which is retained in the channel 12, and which will be described in more detail in due course.

As illustrated in FIGS. 1(*a*) and 1(*b*), the attachment component 10 comprises a first external wall portion 14, which in this embodiment defines part of a first external side of the track 1, and a second external wall portion 16, which defines a reverse external side of the guide track. In this embodiment the attachment component 10 further comprises a third external wall portion 18 which defines a second external side of the track 1.

The attachment component 10 further comprises a first internal wall portion 15, which is parallel to and spaced apart from the first external wall portion 14, a second internal wall portion 17, which is parallel to and spaced apart from the second external wall portion 16, and a third internal wall portion 19, which is parallel to and spaced apart from the third external wall portion 18. The second internal wall portion 17 extends between the first and third internal wall portions 15, 19. Depending from the third external wall portion 18, there is provided a fourth external wall portion 20 which provides a front wall portion of the track. The front wall portion, provided by the fourth external wall portion 20, is less than half the width of the track: that is, it is less than half the width of the second external wall portion 16. A fourth internal wall portion of 21 is parallel to and spaced apart from the fourth external wall portion 20, and is connected to the third internal wall portion 15. A slot wall portion 22 extends between the fourth external wall portion 20 and the fourth internal wall portion of 21, and slightly beyond the fourth internal wall portion of 21, to provide an internal ridge 23.

In the illustrated embodiment the first and third external wall portions 14, 18 are substantially parallel, and are substantially perpendicular to the second and fourth external wall portions 16, 20 to assist in providing a track which is generally rectangular in transverse cross section.

In this embodiment the second external wall portion 16 and the second internal wall portion 17 are provided with a number of apertures (not shown), respective apertures in these wall portions being aligned to allow insertion of fasteners, such as screws 4, therethrough. The apertures in the second internal wall portion 17 are large enough to allow passage of the heads of the fasteners therethrough, whereas the apertures in the second external wall portion 16 are sized to prevent the passage of the heads of the fasteners therethrough. Thus, fasteners can be used to attach the attachment component to a support structure by, effectively, fastening the second external wall portion 16 to the support structure, with the heads of the fasteners located between the second external wall portion 16 and the second internal wall portion 17.

A space between the first external wall portion 14 and the first internal wall portion 15, provides a receiving cavity 25, for facilitating attachment of the additional component 40 to the attachment component 10, as will be described in due course. An internal surface of the receiving cavity 25 is provided with one or more securing features 26, to assist retention of the additional component 40. In this embodiment a securing feature 26 is in the form of a groove provided on an interior surface of the first external wall portion 14. The opening of the receiving cavity 25 may be provided with a taper or bevel 27, which can facilitate insertion of another component (in this embodiment the connecting component 80, as will be described hereafter) into the receiving cavity 25, and also provide an aesthetically pleasing join.

The additional component 40 comprises a first wall portion 44, which in use aligns with the first external wall portion 14 of the attachment component 10 to provide a first external side surface of the track 1 (as can be seen in FIG. 1 (*a*)). The additional component 40 further comprises a second wall portion 46, which in this embodiment is generally parallel to but offset from the first wall portion 44, and which in use provides an insertion portion, insertable into the receiving cavity 25 to assist in connecting the additional component 40 to the attachment component 10. A short connection wall 48 connects the first wall portion 44 to the second wall portion 46.

The additional component 40 further comprises a third wall portion 50, which provides a front wall portion of the track. The front wall portion provided by the third wall portion 50, is less than half the width of the track, that is, it is less than half the width of the second external wall portion 16, and in the assembled track 1 is arranged generally parallel to and co-planar with the fourth external wall portion 20 of the attachment component 10. Thus in the assembled track 1 the third wall portion 50 of the additional component 40 and the fourth external wall portion 20 of the attachment component 10, together provide a front wall of the track with a central elongate slot through which material of a blind may pass when the edge portion 2 is entrapped or retained within the channel 12.

The additional component 40 further comprises a fourth wall portion 52, which in this embodiment depends generally perpendicular to the third wall portion 50, and which in use provides a slot wall generally parallel to and spaced apart from slot wall portion 22 of the attachment component 10. An interior feature 54 provided on the fourth wall portion 52, can assist in retaining the additional component 40 relative to the connecting component 80 in use, as will be described hereafter.

The connecting component 80 comprises an insertion end region 82 for insertion into the receiving cavity 25 of the attachment component 10, and a supporting end region 84 for supporting the additional component 40. The insertion end region 82 comprises a first elongate portion 86 for contacting the first internal wall portion 15 of the attachment component 10 (which defines one side wall of the receiving cavity 25), and a second elongate portion 88 for contacting first external wall portion 14 of the attachment component 10 (which defines the other side wall of the receiving cavity 25). The first and second elongate portions 86, 88 are connected together by a hinge region 90, which allows some movement of the second elongate portion 88, relative to the first elongate portion 86. The movement allowed by the hinge region 90 is in the rotational directions indicated by the arrow 'A' in FIG. 1(*b*). The equilibrium position of the second elongate portion 88, relative to the first elongate portion 86 is shown in FIG. 1(*b*).

The second elongate portion 88 is provided with a securing feature, which in this embodiment is in the form of a ridge 89 thereon, which is adapted to cooperate with a securing feature, which in this embodiment is in the form of a groove 26, provided on interior surface of the first external wall portion 14. This can allow secure retention of the connecting component 80 in the receiving cavity 25, as shown in FIG. 1(*a*). The space between the first and second elongate portions 86, 88 is adapted to receive the second wall portion 46 of the additional component 40, which in this embodiment, in use, provides an insertion portion.

When the insertion end region 82 of the connecting component 80 is inserted in the receiving cavity 25 and the second wall portion 46 of the additional component 40 is inserted between the first and second elongate portions 86, 88, the first and second elongate portions 86, 88 are forced against the side walls 14, 15 of the receiving cavity 25, so that the insertion end region 82 of the connecting component 80 cannot be removed from the receiving cavity 25. That is, the second wall portion 46 spaces apart the first and second elongate portions 86, 88 so that the ridge 89 cannot be withdrawn from the groove 26.

When the second wall portion 46 of the additional component 40 is removed from between the first and second elongate portions 86, 88, the freedom of the second elongate portion 88 to move relative to (towards) the first elongate portion 86 allows ridge 89 to be withdrawn from the groove 26, and the connecting component 80 to be removed from the receiving cavity 25 if desired. In an alternative embodiment the ridge 89 and the groove 26 could be omitted, and the frictional engagement of the first and second elongate portions 86, 88 against the interior surfaces of the side walls 14, 15 of the walls of the receiving cavity 25 could be used to retain the insertion end region 82 in the receiving cavity 25, but the provision of the ridge 89 and the groove 26 is considered to provide more secure attachment.

The insertion end region 82 is an example of a deformable region which can be received and retained by a portion of the attachment component, with the second wall portion 46 of the additional component 40 acting as a locking portion.

The supporting end region 84 of the connecting component 80 comprises a first wall portion 92 which in use provides a side interior wall of the channel 12 and an end region 92A of which abuts and supports a central region of third wall portion 50 of the additional component 40. A central region 93 of the first wall portion 92 is adapted to abut and support a part of the second wall portion 46 of the additional component 40 which does not extend into the space between the first and second elongate portions 86, 88 of the end region 82.

A second wall portion 94 of the additional component 40 extends perpendicular from the first wall portion 92, spaced apart from the third wall portion 50 of the additional component 40, to form a front internal wall of the channel 12, which in the assembled track (as illustrated in FIG. 1(*a*)) is spaced apart from, but generally coplanar with, the fourth internal wall portion 21 of the attachment component 10.

A third wall portion 96 of the connecting component 80 extends from the distal end of the second wall portion 94, to the third wall portion 50 of the additional component 40, which it abuts and supports in the assembled track. The distal end of the second wall portion 94, where it transitions to the third wall portion 96, abuts and supports the fourth wall portion 52 of the additional component 40, so that the third wall portion is retained between the interior feature 54 provided on the fourth wall portion 52 of the additional component 40 and the interior surface of the third wall portion 50 of the additional component 40.

The attachment component 10, additional component 40, and connecting component 80 may be formed as extrusions. The attachment component 10 and additional component 40 may be made from a material which is substantially rigid in use, such as aluminum. The connecting component 80 (and especially the hinge region 90) may be made from a more flexible material than the attachment component 10 and additional component 40, for example, a suitable plastic. However, the support provided to the additional component 40 by the connecting component 80 may nonetheless be valuable in maintaining rigidity of the additional component 40 in use.

It will be appreciated from the description herein that the attachment component 10, additional component 40, and connecting component 80 are, together, capable of forming a guide track having a channel 12 which can be used to retain an object, which can be allowed to move along the length of the channel 12. The components could, if desired, be dimensioned to provide a narrow slot, so that a thickened edge region of a blind or the like could be retained in the channel. Thus it may not be necessary, or desired, to provide a further component in the channel to assist in retaining an object therein.

However, according to the illustrated embodiment, the track 1 further comprises in an inner retainer member 100, which is retained in the channel 12 in the assembled track 1.

The inner retainer member 100 is adapted to be located in the channel 12, and comprises a back wall 102 adapted to abut the second internal wall portion 17 of the attachment component 10. Provided on the back wall 102 is a retaining structure comprising a wall arrangement 104 defining an interior channel 106 and a narrow front slot 108. The interior channel 106 is adapted to retain the edges region 2 therein, and the front slot 108 is adapted to accommodate part of the sheet material 3 adjacent the edge portion 2. The back wall 102 and the wall arrangement 104 are formed from a relatively stiff material. Attached to the back wall 102, at each lateral side of the wall arrangement are respective first and second retaining fins 110, 112. Each retaining fin is slightly arcuate and formed from a somewhat resilient material. The relatively stiff material forming back wall 102 and the wall arrangement 104 is integrally molded/extruded with the somewhat resilient material forming the first and second retaining fins 110, 112 to provide a one-piece member in which the different parts have the desired characteristics. Suitable co-molding and co-extrusion processes are known per se.

The distal ends of the retaining fins 110, 112, respectively are adapted to engage front interior walls of the channel 12, which in this embodiment are provided by the fourth internal wall portion 21 of the attachment component 10, and by the second wall portion 94 of the connecting component 80, respectively. Thus the retaining fins 110, 112, in use, bias the retainer member 100 towards the reverse (rear) of the attachment component 10, providing a light tension to the sheet material 3 which can contribute to providing an aesthetically pleasing blind arrangement, and also reduce unwanted movement of the blind due to wind or the like.

Installation and assembly of the track 1 will be described hereafter with reference to FIGS. 2(*a*) to 2(*d*).

As illustrated in FIG. 2(*a*), the attachment component 10 is first attached, at a desired position, to a support structure (not shown) using fasteners, for example screws 4. The edge region 2 is threaded into the interior channel 106 of the inner retainer member 100.

As illustrated in FIG. 2(*b*), the inner retainer member 100, with the edge region 2 threaded therein, is placed against the second internal wall portion 17 of the attachment component 10, corresponding to being inserted into a space, defined by the attachment component 10, which will become the channel 12 when the track 1 is assembled.

As illustrated in FIG. 2(*c*), the insertion end region 82 of the connecting component 80 is then laterally inserted into the receiving cavity 25 of the attachment component 10, where it is gently held by the resilient outward bias of the first and second elongate portions 86, 88, which are forced together compared to their equilibrium position by the insertion between the side walls of the receiving cavity 25. Further, the ridge 89 is retained in the securing feature (groove) 26.

As illustrated in FIG. 2(*d*), the second wall portion 46 of the additional component 40 is then laterally inserted between the first and second elongate portions 86, 88, so that the first and second elongate portions 86, 88 are forced against the side walls 14, 15 of the receiving cavity 25. While the second wall portion 46 of the additional component 40 is so positioned, the first and second elongate portions 86, 88 are retained in the illustrated spaced apart arrangement and the connecting component 80 cannot be removed from the receiving cavity 25 (for example because the ridge 89 cannot be removed from the securing feature, groove 26). In this arrangement the assembly of the track 1 is complete.

The second elongate portion 88 of the connecting component is provided with texture, such as ridges 87 (see FIG. 1(*b*)), to resist inadvertent removal of the second wall portion 46 of the additional component 40 from between the first and second elongate portions 86, 88. However, if desired the second wall portion 46 of the additional component 40 can be manually removed from between the first and second elongate portions 86, 88.

With such a track provided at each side of the blind, the blind can be operated, as will be appreciated by the skilled addressee, by application of appropriate force to move the sheet material, with the edge region 2 retained and slideable within the interior channel 106 of the inner retainer member 100, and the inner retainer member 100 retained in the channel 12.

If the second wall portion 46 of the additional component 40 is removed from between the first and second elongate portions 86, 88, the second elongate portion 88 becomes again free to move relative to the first elongate portion 86, allowing the connecting component 80 to be removed from the receiving cavity 25 if desired.

It will therefore be appreciated that the second wall portion 46 of the additional component 40, and the additional component 40 as a whole, can be manually removed from the assembly if desired by manually forcing the additional component 40 laterally away from the connecting component 80. Once the second wall portion 46 is removed from between the first and second elongate portions 86, 88 of the connecting component 80, the second elongate portion 88 can be manually forced towards the first elongate portion 86, disengaging the ridge 89 from the securing feature (groove) 26. The connecting component 80 can then be manually removed from the receiving cavity 25 by manually forcing the connecting component 80 laterally away from the attachment component 10. Thus access to the channel 12, for example for repair, maintenance or disassembly, is quick and straightforward.

Thus disassembly is effectively the reverse process to assembly.

It will be appreciated that no fasters such as screws, rivets, or the like are used to attach the additional component 40 to the attachment component 10, which avoids the need to deal with such individual fasteners, making assembly and disassembly quick and straightforward, and contributes to a smooth and aesthetically pleasing finish. It will also be appreciated that first wall portion 44 of the additional component 40 abuts the first external wall portion 14 of the attachment component 10, so that the connecting component 80 does not show from the exterior of the track 1. In this embodiment a bevelled end 47 of the first wall portion 44 abuts and overlaps the bevelled end 27 of the first external wall portion 14 of the attachment component 10, providing an aesthetically pleasing and somewhat inconspicuous join.

Figures 3A, 3B:
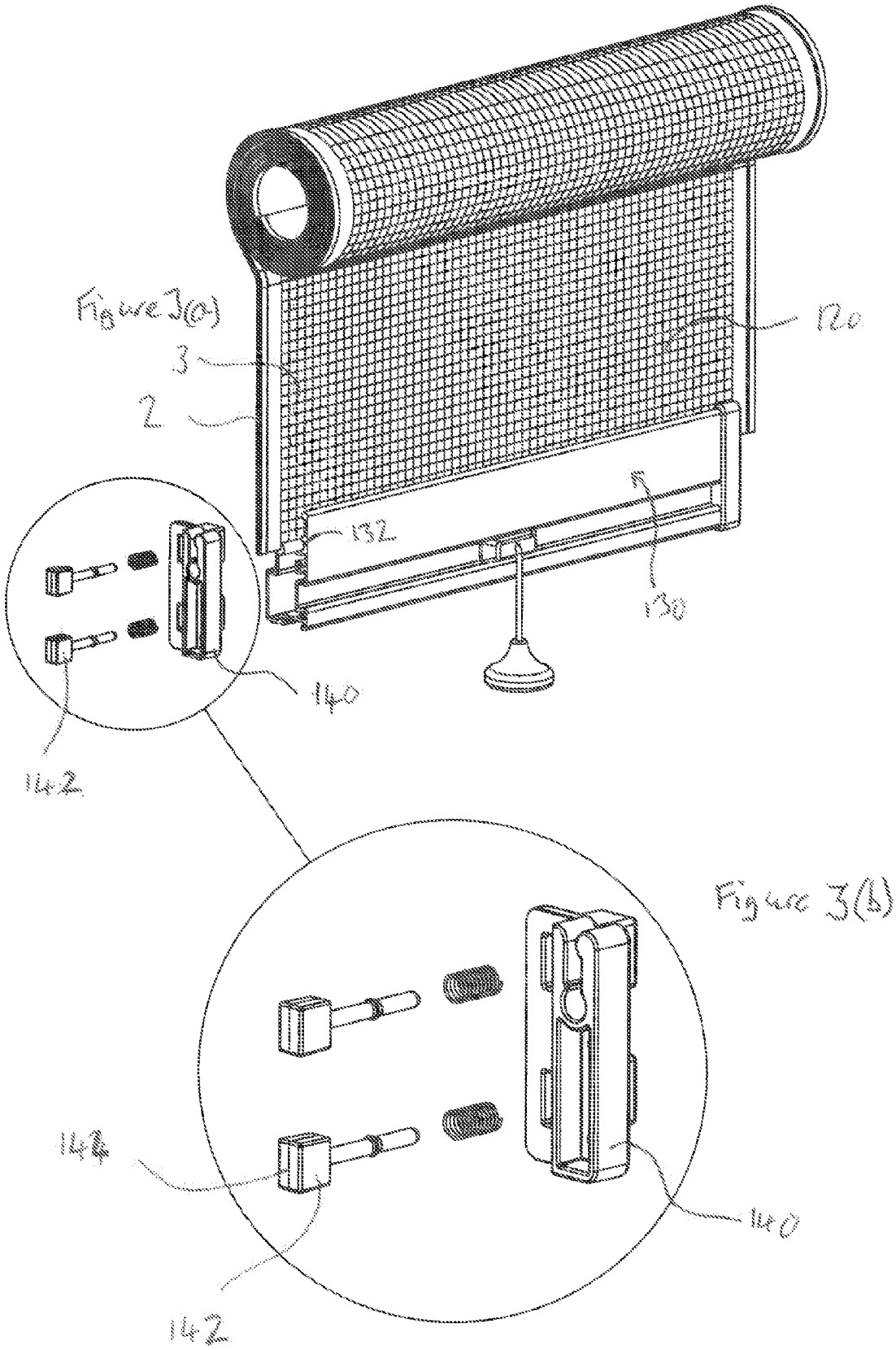
FIG. 3(*a*) is a perspective, partially exploded view of an embodiment of a blind and bar arrangement for use with the track of FIG. 1(*a*)
Figure 4A:
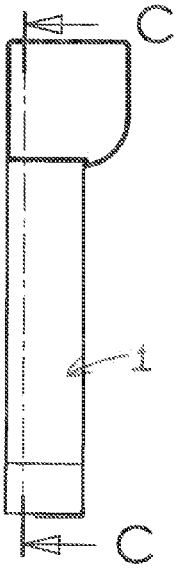
FIG. 4(*a*) is a side view of a blind assembly including first and second tracks each of the type illustrated in FIG. 1(*a*) and the blind and bar arrangement of FIG. 3(*a*)
Figure 4B:
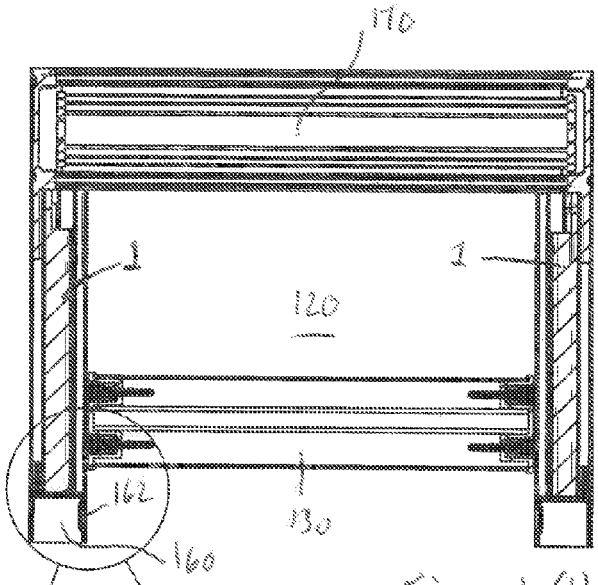
Figure 5:
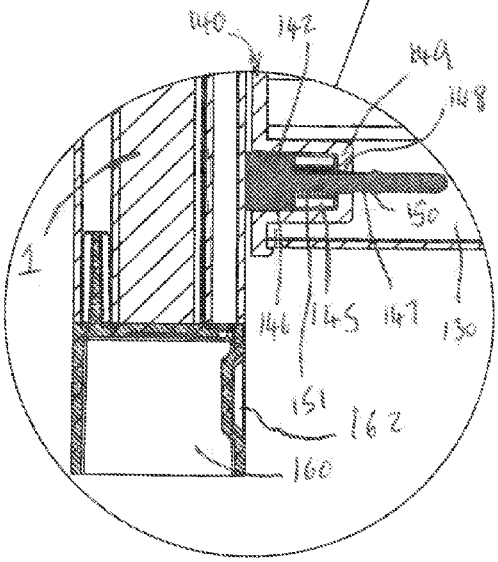
FIG. 5 is a cross sectional view of a detail of FIG. 4(*b*) with the blind and bar arrangement in a partially raised position.
Figure 6:
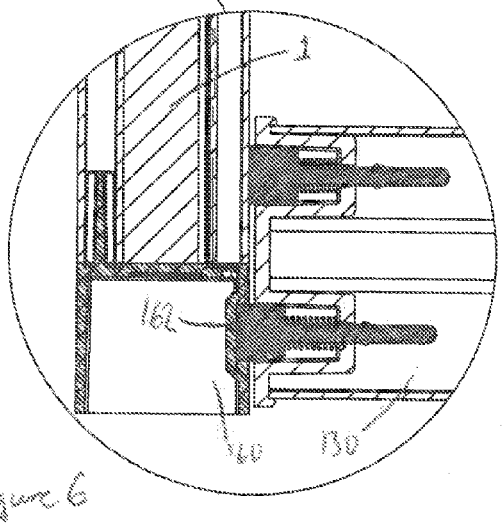
FIG. 6 is a cross sectional view of a detail of FIG. 4(*b*) with the blind and bar arrangement in a fully lowered position.

FIG. 3(*a*) is a perspective, partially exploded view of an embodiment of a blind 120 having a bar 130 along a bottom edge thereof. The bar 130, and its components which will be described hereafter, may be regarded as part of an apparatus for retaining a blind. FIG. 3(*b*) is an enlarged view of a side assembly of the bar 130 shown in FIG. 3(*a*). The blind 120 and bar 130 arrangement is suitable for use with the track 1 of FIGS. 1(*a*) to 2(*d*). FIGS. 4(*b*), 5 and 6 show further detail of side assembly of the bar 130 in cross section, and in use, in a window opening, with a track of the type illustrated in FIGS. 1 (*a*) to 2 (*d*).

The blind 130 provides an edge region 2 on each side thereof and is made from a flexible sheet material 3. Any suitable sheet material known per se for use in blinds can be used, but in this embodiment the sheet material is a material which is relatively highly transmissive of visible light, but which resists the transmission of heat. An example of a suitable material, known per se, is a material sold under the trade mark SOLTIS 99 by the French manufacturing group Serge Ferrari. It will be appreciated that resisting the transmission of heat acts synergistically with the 'sealing' of the edges of the blind to a window or door frame to provide a product which helps reduce energy costs by reducing heat transfer into or out of, for example, a room of a building where the blind is used.

The bar 130 comprises an attachment region 132 for attachment to an end (in this embodiment a bottom) edge of the blind 120. The bar comprises side plates, of which one, side plate 140 is shown. The side plate 140 attaches to a side of the bar 130, adjacent an edge region 2 of the blind. The side plate 140 provides at least one resistance member 142, which is biased away from the centre of the bar 130. The at least one resistance member 142 provides a frictional surface 144, adapted to engage part of the track 1. In the illustrated embodiment the frictional surface 144 is adapted to engage the fourth external wall portion 20. Thus it will be appreciated that the at least one resistance member 142 is not coplanar with the blind 120, but is offset relative to the blind. This frictional engagement provides some resistance to extension or retraction of the blind, allowing the degree of extension to be easily controlled. In an embodiment the use of the resistance members, in cooperation with a biased or spring loaded roller (known per se in the field of blinds) provides sufficient control of the extension of the blind to allow convenient and reliable operation of the blind in the absence of other extension control features, such as guide chains, which are sometimes used to control the extension of blinds (for example to avoid a biased roller retracting the blind when such retraction is not desired). The bar may be positioned by a user at any position along the guide tracks and retained in that position by the resistance members, thus providing freedom to extend or retract the blind to any desired extent.

Figure 7:
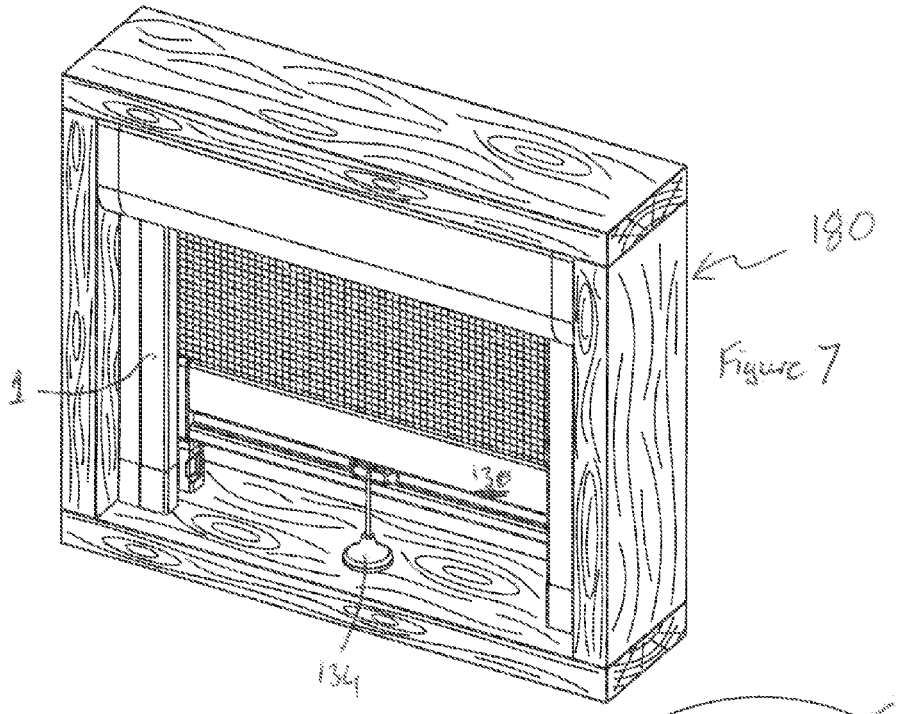
FIG. 7 is a perspective view of the blind assembly of FIG. 4(*b*) installed in a window opening.

The at least one resistance member 142 may be retractable to temporarily reduce or negate contact of the frictional surface 144 with the track 1, allowing the blind to be extended or retracted without such frictional resistance. As illustrated in FIGS. 4(*b*), 5 and 6, the at least one resistance member 142 is retained in a recess 145 provided in the side plate 140, but is able to extend sightly therefrom in order to contact the track 1. The at least one resistance member 142, comprises a block 146, which provides the frictional surface 144 on one side thereof, and which is provided with a stem 147, on the other side thereof. The stem 147 extends through an aperture 148 in an internal wall 149 of the recess 145, and is provided with a widened region or flange 150, so that the resistance member 142 is retained relative to the internal wall 149. A biasing member, such as a spring 151, is arranged around the stem 147, and acts between the internal wall 149 and the block 146, to bias the resistance member laterally outwardly. The stem 147 may be connected, for example by a cord (not shown) to a handle or knob 134 (see FIGS. 7 and 8), provided on the bar 130, and in this embodiment at the centre of the bar 130. Thus pulling or other operation of the handle or knob 134 can act to retract the at least one resistance member 142. In the illustrated embodiment, for example as illustrated in FIG. 4(*b*), four resistance members 142, are provided, two at either side of the bar 130. Each may operate in a similar manner, and all four may be connected to, and operable by, the handle or knob 134.

As shown in FIGS. 4(*b*), 5, 6, 7 and 8, the track 1 may terminate, for example at its lower end, at an end block 160 which provides a recess 162 for accommodating the one of the resistance members. This provided a securing mechanism for the blind 120, as the resistance member will remain retained in the recess 162 until the resistance member is retracted, for example by operation of the handle or knob 134. The recess may assist in preventing opening of a closed blind from the outside. In this embodiment the end block 160 does not extend above the height of the bar 130, and does not need to be able to accommodate the edge 2 of the blind 120.

It will be appreciated that, if desired, the track 1 could be provided with recesses similar in function to the recess 162, in order to allow the blind to be more securely retained at different heights. Because, with the blind partially open access to the handle or knob 134 would be straightforward from either inside or outside the window opening, for this to serve a security function a security arrangement, such as, for example, a key-based lock, would need to be incorporated into the mechanism for retracting the resistance member(s). Such an arrangement may, for example, be useful in allowing a blind to be secured in a position where it provides a narrow opening, to allow passage of small pets such as cats, while preventing, or deterring passage of children or other persons. However, normally such additional recesses will not be required.

FIGS. 4(*a*) to 8 illustrate the track 1 in use with a blind 120 and bar 130 arrangement in a window opening. The blind can be retracted onto a roller 170, in a manner known per se.

Figure 9:
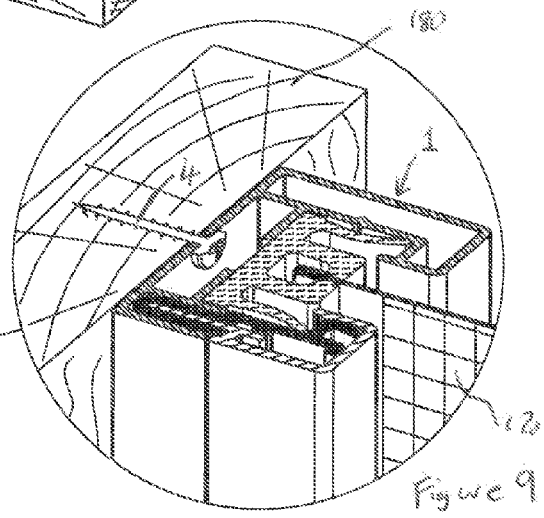
FIG. 9 is an enlargement of a detail of FIG. 8.
Figure 8:
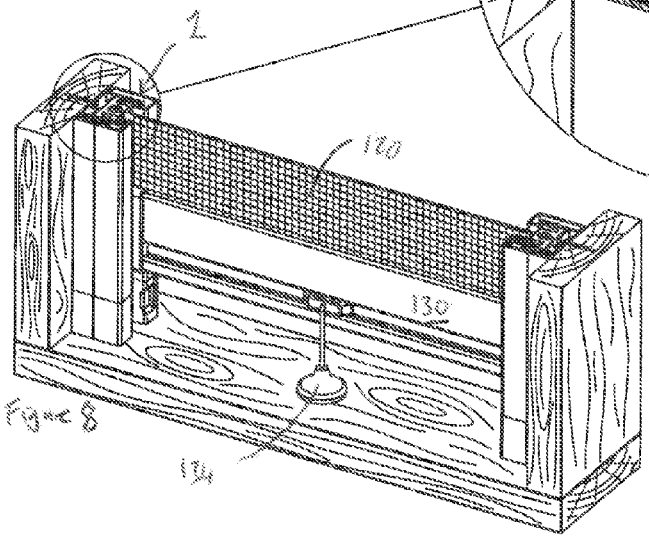
FIG. 8 is a truncated view of a bottom part of the blind assembly of FIG. 7, showing some internal detail of one track.

FIGS. 8 and 9 show a transverse cross sectional view of the track 1, which is consistent with FIGS. 1(*a*) and 2(*d*).

In this embodiment the track 1 is mounted to a support structure in the form of a window frame 180, so that it is located within the window frame 180, and does not extend into a room any more than does the window frame. Thus the support structure is on one side of the track 1, and the blind 120 extends out of the opposite side of the track 1. This is consistent with the fasteners, eg screws 4 extending through a reverse or rear wall of the track 1 and the blind extending, in a direction opposite to direction of insertion of the screws 4, from the slot provided in a front wall of the track.

Figure 10:
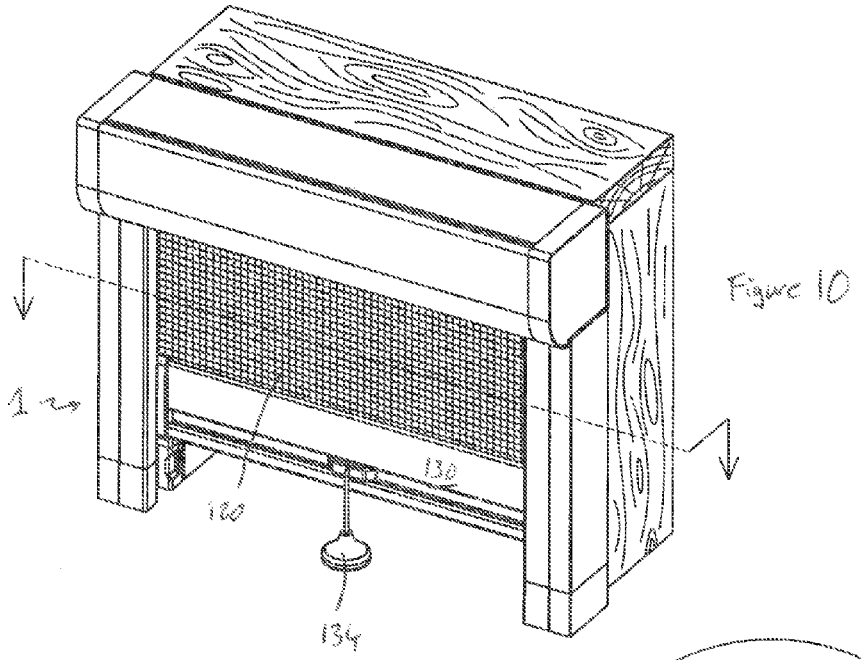
FIG. 10 is a perspective view of a variation of the blind assembly of FIG. 4(*b*) installed in a window opening.
Figure 12:
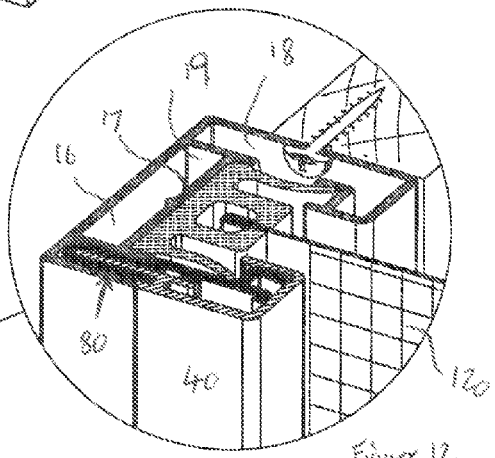
FIG. 12 is an enlargement of a detail of FIG. 10.
Figure 11:
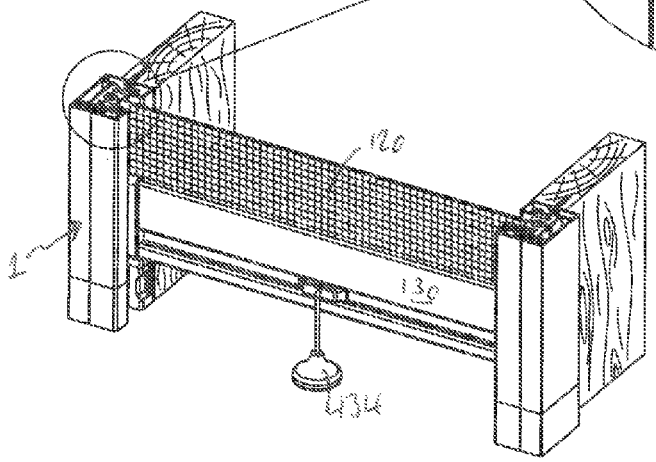
FIG. 11 is a truncated view of a bottom part of the blind assembly of FIG. 10, showing some internal detail of one track.

FIGS. 10 to 12 show a variation in which the track 1 is mounted to what may be regarded as the front of a window frame. As the variation of this embodiment from the previously described embodiment is very slight, corresponding reference numerals are used. This variation may be appropriate, for example, if it is desired that the frame should not narrow the window opening or if the depth of the window frame is not sufficient to accommodate the track. In this embodiment the direction of extension of the blind 120 across the window is substantially perpendicular to the direction of insertion of the screws 4 (rather than substantially opposite to the direction of the screws as previously described). The track 1 easily accommodates this variation, requiring only that the apertures for the screws 4 are provided in the third external wall portion 18 (which may be regarded as defining an external 'side' of the track 1) and the third internal wall portion 19 portion, rather than in the second external wall portion 16 (which may be regarded as defining an external 'reverse side' or rear of the track 1) and the second internal wall portion 17, as previously described. The screws 4 can be easily inserted through apertures provided in the third external wall portion 18 and the third internal wall portion 19 portion, as these wall portions are easily accessible prior to attachment of the additional component 40 and the connecting component 80 to the attachment component 10.

The described embodiments provide various benefits. The assembly of the track 1 can be easily performed, and attachment of the various components of the track to each other does not require fixings such as screws or rivets. The use of screws or rivets to attach the components to each other can be time consuming, and can result in parts of the screws or rivets being visible in the finished track, which is unsightly. Further, the use of screws or rivets to attach the components to each other can make disassembly, for example for maintenance or repair, time consuming. Further, such screws or rivets may be made from a metal different to the metal from which (at least some of) the components are made, leading to galvanic corrosion, which can be problematic or at least unsightly.

In contrast to the use of fixings such as screws the connecting component allows secure attachment of the additional component 40 to the attachment component 10, and secure retention of the inner retainer member 100. Retention of a blind by the described embodiment has been found to be sufficiently secure to resist impacts and strong winds.

Further, in the described embodiments the components can be attached by a lateral movement of one component relative to another, which is a simple operation, and requires little working space.

Further, the open nature of the attachment component 10, prior to assembly of the track, makes the attachment of the attachment component to a support structure easy, and facilitates attachment by insertion of screws through either a rear wall or a side wall, as discussed above.

The provision of an inner retainer member 100 which is made as a single piece provides a robust, attractive and easy to use component. Manufacture by co-molding, or an equivalent extrusion process, allows the single piece inner retainer member 100 to provide sturdy support of the retained part of a blind, while providing suitably resilient parts to bias the retainer member 100 in a desired manner.

The use of track members, which effectively seal the edges of a blind to the edges of an opening, in combination with a blind material which resists the passage of heat, provides particular benefits in reducing heat flow through an opening in which the blind is installed.

The use of a bar arrangement with frictional members (which may be regarded as effectively being brakes) allow a blind to be positioned at any desired extension and can eliminated the need for chain drives.

Modifications and variations may be incorporated without departing from the scope of the invention.

The claims defining the invention are as follows:

1. An apparatus for retaining a blind comprising:

a first elongate element for attachment to a supporting structure;

a second elongate element attachable to the first elongate element to at least partially form a guide track providing a guide channel in which a part to be guided is constrained, the first and second elongate elements together at least partially defining external surfaces of the guide track; and a retainer element, which is attachable to and detachable from the first and second elongate elements, and which is adapted to fit between the first and second elongate elements;

the second elongate element being attachable to the first elongate element by displacement of the second elongate element relative to the first elongate element, by an attachment arrangement comprising:

a receiving portion provided by one of the first and second elongate elements; and a retainable locking portion, provided by one of the first and second elongate elements that does not have a receiving portion provided thereon;

wherein the retainer element comprises a retainable portion for receipt by, and retention relative to, the receiving portion, the retainable portion comprising at least two relatively moveable portions adapted to be retained in a spaced apart arrangement by insertion therebetween of said retainable locking portion so that the retainable locking portion is gripped between the relatively moveable portions;

wherein the retainable locking portion is adapted to lock the retainable portion to the receiving portion by retention of the two relatively moveable portions in the spaced apart arrangement, and wherein the retainer element is unlockable from the receiving portion only when the retainable locking portion is not inserted to retain the relatively moveable portions in the spaced apart arrangement.

2. An apparatus according to claim 1, wherein the first elongate element has a direction of elongation and wherein the second elongate element is attachable to the first elongate element by displacement of the second elongate element relative to the first elongate element in a direction substantially transverse to the direction of elongation of the first elongate element.

3. An apparatus according to claim 1, wherein the part to be guided is an edge of a blind, wherein the guide track provides an elongate slot connected to the guide channel to allow a part of the blind connected to the part to be guided to extend out of the guide channel via the slot, and wherein the first elongate element provides a side wall of the elongate slot and the second elongate element provides a further side wall of the elongate slot.

4. An apparatus according to claim 1, wherein the retainable portion comprises a deformable portion receivable by the receiving portion.

5. An apparatus according to claim 4, wherein the retainable locking portion is adapted to prevent disconnection of one or more securing features of the deformable portion from one or more complementary securing features of the receiving portion.

6. An apparatus according to claim 1, wherein the receiving portion comprises at least one elongate receiving channel and the retainable portion comprises an insertion portion adapted to be retained in the receiving portion.

7. An apparatus according to claim 1, wherein retention of the two relatively moveable portions in a spaced apart arrangement is adapted to retain a securing feature of the retainer element in engagement with a complementary securing feature of the receiving portion provided by one of the first and second elongate elements, and wherein in the absence of the retainable locking portion the securing feature of the retainer element is disengageable from the complementary securing feature.

8. An apparatus according to claim 7, wherein in the absence of the retainable locking portion the at least two relatively moveable portions are adapted to be forced together to disengage the securing feature of the retainer element from the complementary securing feature.

9. An apparatus according to claim 1, wherein the retainer element comprises at least one of:

a portion which provides an interior wall portion of the guide channel;

a portion which abuts and supports an external wall portion of the guide track; and a portion which abuts and supports a wall portion of the guide track which at least partially defines a slot in the guide track for allowing connection between the part to be guided and a connected part of a blind external to the guide track.

10. An apparatus according to claim 1, wherein the apparatus for retaining a blind comprises a constraining element adapted to be retained in the channel of the guide track, the constraining element comprising:

a structure defining an internal channel for constraining a part of a blind to be guided and a slot connected to the internal channel to allow connection between the part to be guided and a connected part of the blind external to the internal channel; and a plurality of resilient biasing members for contacting one or more internal walls of the channel of the guide track and biasing the constraining element in the channel of the guide track in a direction opposed to a direction in which the slot of the constraining element extends away from the internal channel of the constraining element;

wherein the structure defining the internal channel of the constraining element is made of a different material to the resilient biasing members.

11. An apparatus according to claim 1, wherein the apparatus for retaining a blind comprises a bar arrangement adapted to be attached to a bottom edge of a blind and to extend between two guide tracks, wherein the bar arrangement is adapted to engage the guide tracks and to be guided thereby, and wherein the bar arrangement comprises at least one engaging member for frictionally engaging one of said guide tracks, said engaging member being biased by a resilient member to force the engaging member against the guide track, wherein the force applied by one or more engaging members against one or more guides is sufficient to retain a blind in a desired position against a retraction force applied to the blind by a biased roller.

12. An apparatus according to claim 11, wherein the bar arrangement is provided with an arrangement for reducing the force applied by an engaging member against a guide track, wherein the arrangement for reducing the force applied comprises a manually engageable part coupled to said engaging member, and operable to reduce the force applied by the engaging member against the guide by applying a force to an engaging member substantially opposed to a bias of the engaging member.

13. A blind assembly comprising:

first and second guide track assemblies each provided by an apparatus in accordance with claim 1;

a blind having first and second edge regions for retention in the channels of the first and second guide track assemblies; and a bar for location at an end of the blind.

14. An apparatus for retaining a blind comprising:

a first elongate element for attachment to a supporting structure in order to attach the apparatus to said supporting structure;

a second elongate element attachable to the first elongate element, in order to at least partially form a guide track providing a guide channel in which a part to be guided may be constrained, each of the first and second elongate elements at least partially defining external surfaces of the guide track;

a third elongate element, adapted to be located between the first and second elongate elements in order to assist attachment of the second elongate element to the first elongate element; and a constraining element adapted to be retained in the guide channel of the guide track, the constraining element comprising:

a structure defining an internal channel for constraining a part of a blind to be guided and a slot connected to the internal channel to allow connection between the part to be guided and a connected part of the blind external to the internal channel; and a plurality of resilient biasing members for contacting one or more internal walls of the guide channel of the guide track and biasing the constraining element in the guide channel of the guide track in a direction opposed to a direction in which the slot of the constraining element extends away from the internal channel of the constraining element;

wherein the structure defining the internal channel of the constraining element is made of a different material to the resilient biasing members;

wherein each of the first and third elongate elements provides an internal wall surface part of the guide channel of the guide track for contact by a respective one of said resilient biasing members of the constraining element, configured so that contact of the resilient biasing members with said internal wall surface parts resiliently biases the constraining element away from said internal wall surface parts in use;

wherein the first elongate element has a direction of elongation and provides a receiving portion for receiving a retainable portion of the third elongate element therein by displacement of the third elongate element relative to the first elongate element in a direction substantially transverse to the direction of elongation of the first elongate element;

wherein the second elongate element is attachable to the first elongate element by displacement of the second elongate element relative to the first elongate element in a direction substantially transverse to the direction of elongation of the first elongate element so that the second elongate element is retained in contact with the third elongate element; and wherein each of the first, second and third elongate elements is in the form of an extrusion.

15. An apparatus according to claim 14, wherein the third elongate element comprises a receiving portion for retainable receipt of a retainable portion of the second elongate element and wherein insertion of the retainable portion of the second elongate element into the receiving portion of the third elongate element acts to lock the third elongate element to the receiving portion of the first elongate elements.

16. An apparatus according to claim 10, wherein the retainer element comprises a portion which provides an interior wall portion of the guide channel, and wherein the apparatus is configured so that one of the plurality of resilient biasing members of the constraining element contacts the interior wall portion which is provided by retainer element so as to bias the constraining element in the guide channel of the guide track in said direction opposed to the direction in which the slot of the constraining element extends away from the internal channel of the constraining element.

* * * * *